US010736203B2

(12) United States Patent
Hamm

(10) Patent No.: US 10,736,203 B2
(45) Date of Patent: Aug. 4, 2020

(54) SYSTEM FOR CONTROLLING THE ELECTRICAL POWER SUPPLY OF AN ENERGISER FOR AN ELECTRIC FENCE AND METHOD FOR OPERATING SAID SYSTEM

(71) Applicant: LACME HOLDING, La Garenne Colombes (FR)

(72) Inventor: Valéry Hamm, La Fleche (FR)

(73) Assignee: LACME HOLDING, La Garenne Colombes (FR)

( * ) Notice: Subject to any disclaimer, the term of this patent is extended or adjusted under 35 U.S.C. 154(b) by 153 days.

(21) Appl. No.: 16/078,260

(22) PCT Filed: Feb. 20, 2017

(86) PCT No.: PCT/FR2017/050371

§ 371 (c)(1),
(2) Date: Aug. 21, 2018

(87) PCT Pub. No.: WO2017/144803

PCT Pub. Date: Aug. 31, 2017

(65) Prior Publication Data

US 2019/0053362 A1 Feb. 14, 2019

(30) Foreign Application Priority Data

Feb. 23, 2016 (FR) ..... 16 51451

(51) Int. Cl.
*H05C 1/04* (2006.01)
*H05C 3/00* (2006.01)

(52) U.S. Cl.
CPC ..... *H05C 1/04* (2013.01); *H05C 3/00* (2013.01)

(58) Field of Classification Search
CPC ..... H05C 1/04; H05C 3/00
See application file for complete search history.

(56) References Cited

U.S. PATENT DOCUMENTS 5,973,413 A 10/1999 Walley
2010/0219699 A1 9/2010 Hurly
2013/0157628 A1* 6/2013 Kim ..... A01K 15/023 455/414.1
2017/0303375 A1* 10/2017 Woodhead ..... H02J 50/12

FOREIGN PATENT DOCUMENTS

DE 10219777 A1 * 11/2003 ..... H05C 1/04
FR 2814035 3/2002

OTHER PUBLICATIONS

International Search Report dated Jun. 1, 2017.

* cited by examiner

*Primary Examiner* — Daniel J Cavallari
(74) *Attorney, Agent, or Firm* — Ipsilon USA, LLP

(57) ABSTRACT

The invention relates to a system comprising a remote control (21), a pull-out box (8) comprising an emitting and receiving RF chip (16), a switch (14) controlling the electrical power supply of the energiser (4), and a first electronic circuit (15) for operating the switch (14), exchanging RF signals with the RF chip (16). The system comprises a remote control (20) for reading and emitting signals conducted by the fence wire (2), a galvanic connection (9, 10) to the electric fence, and in the pull-out box, a second electronic circuit (19) for operating the switch (14) in connection with the remote control (20), and means for transforming signals conducted by the wire (2) into RF signals emitted by the RF chip (16).

21 Claims, 2 Drawing Sheets

SYSTEM FOR CONTROLLING THE ELECTRICAL POWER SUPPLY OF AN ENERGISER FOR AN ELECTRIC FENCE AND METHOD FOR OPERATING SAID SYSTEM

RELATED APPLICATION

This application is a National Phase of PCT/FR2017/050371, filed on Feb. 20, 2017, which claims the benefit of priority from French Patent Application No. 16 51451, filed on Feb. 23, 2016, the entirety of which are incorporated by reference.

FIELD OF THE INVENTION

The invention relates to a method for controlling the electrical power supply of an energizer for an electric fence and the control system on which it is based.

Such a system for controlling the electrical power supply of an energizer for an electric fence comprises an electronic control unit for an electric fence, intended to be connected between the energizer of the electric fence and its electrical power supply, comprising a transmitting and receiving RF chip, and comprises a pocket radio controller for controlling the electronic control unit via the RF chip.

The electronic unit contains a switch controlling the electrical power supply of the energizer, and actuates said switch by means of an electronic circuit receiving, and transmitting, RF signals from, and to, said pocket radio controller, such as a smartphone or an RF remote control. In case of intervention on the electric fence, it is possible to remotely control the opening of the switch, which results in the stopping of the circulation of the dissuasion pulses on the fence wire. At the end of intervention, it is also possible to remotely control the closing of the switch and the restoration of the pulses on the fence wire.

PRIOR ART

An electronic unit, intended to be connected between the energizer of the electric fence and its electrical power supply, is usually called piggyback unit.

To ensure the remote controls, there are two types of piggyback units.

In the piggyback units of the first type, such as those described in the documents IE 980 921 and WO 00/22 750, the control signal of the switch is triggered by the user by means of a remote control placed in contact with the fence wire. The control signal is conducted by the fence wire to the piggyback unit which acts on the switch.

In the piggyback units of the second type, such as those described in the documents FR 2 814 035 and DE 10 219 777, the piggyback unit comprises a chip for receiving RF signals. The control signal of the switch is triggered by the user by means of an RF remote control or a cellphone, and is transmitted to the piggyback unit by a private RF link or by the telephone network, respectively.

The drawbacks with these piggyback units are multiple. First of all, they are technically linked to a single control tool, remote control or RF communication apparatus, respectively. If the control tool is not operative for one reason or another (white zone, tool battery discharged, barrier passage badly closed upstream in the electric fence, etc.), the stopping or the restarting of the electric fence can no longer be controlled.

Next, they do not allow for a communication to be established between coded signals conducted by the fence wire and signals conveyed by RF pathway. Finally, they cannot be adapted to electric fences which comprise specific elements such as transponders, remotely-actuatable barrier passages or distinct elements such as remotely-controlled drinking troughs.

The document WO 2009/028 966 describes a command and control assembly for an electric fence based on RF signals to avoid the problems of electrical insulation between, on the one hand, the energizer, and, on the other hand, its command and control modules. In this document, a command module addresses commands to the energizer by RF channel, and a control module, arranged on the electric fence but away from the energizer, monitors the pulses and addresses RF signals to the command module. The command module can be connected by RF with a remote module such as a cellphone. Various accessories of the electric fence, such as gates, can also be controlled by RF signals. This document does not mention a piggyback unit between the electrical power source and the energizer, and it describes the use of only RF signals.

The document WO 2008/020 166 describes an installation for monitoring animals each equipped with an RF transmitter. RF receivers are fixed to electric fence posts and the signals received by these RF receivers are transmitted, one-way, to a fixed central station via the wire of the electric fence. This document does not mention a piggyback unit between the electrical power source and the energizer of the electric fence.

One of the aims of the invention is to propose a system for controlling the electrical power supply of an energizer for an electric fence, which does not include the drawbacks associated with the limitations of the abovementioned documents.

Another aim of the invention is to propose a system for controlling the electrical power supply of an energizer for an electric fence, whose piggyback unit can be installed directly between the electrical power supply and the energizer of an old fence.

Another aim of the invention is to propose a system for controlling the electrical power supply of an energizer for an electric fence which is controlled both by RF signals and by signals conducted by the fence wire.

Another aim of the invention is to propose a method for controlling such a system for controlling the electrical power supply of an energizer for an electric fence.

SUMMARY OF THE INVENTION

A subject of the invention is a method for controlling a system for controlling the electrical power supply of an energizer for an electric fence, consisting of:

an electronic control unit, connected between the energizer and its electrical power supply, comprising a transmitting and receiving RF chip, a switch controlling the electrical power supply of the energizer, a first electronic control circuit of the switch, controlled by RF signals, a galvanic link with the electric fence, and a second electronic control circuit of the switch, controlled by signals conducted by the wire of the fence, a pocket radio controller exchanging RF signals with the RF chip, a pocket remote control transmitting signals conducted by the wire of the electric fence, characterized by the following steps:

a) sending, by the radio controller, of RF control signals stopping the electrical power supply of the energizer, received by the first electronic circuit via the RF chip and ensuring the opening of the switch, b) subsequently, sending, by the remote control, of control signals restoring the electrical power supply of the energizer, conducted by the wire of the electric fence, received by the second electronic circuit via the galvanic link, and ensuring the closing of the switch, and c) transmission by the first electronic circuit of RF signals reporting the closing of the switch, via the RF chip, to the radio controller.

Another subject of the invention is a system for controlling the electrical power supply of an energizer for an electric fence for implementing said control method, comprising a pocket radio controller such as a smartphone or an RF remote control, and an electronic control unit, connected between the energizer and its electrical power supply, incorporating a transmitting and receiving RF chip, exchanging RF signals with the pocket radio controller, also incorporating a switch controlling the electrical power supply of the energizer, and also incorporating a first electronic control circuit of the switch exchanging RF signals with the RF chip, said system being characterized in that:

it comprises a pocket remote control transmitting signals conducted by the wire of the electric fence, the electronic control unit incorporates a galvanic link with the electric fence, the electronic control unit incorporates a second electronic control circuit of the switch, receiving, from the pocket remote control, via the galvanic link, signals conducted by the wire of the electric fence, and the electronic control unit incorporates electronic and/or software means for transforming said signals conducted by the wire of the electric fence into RF signals transmitted by the RF chip.

According to an embodiment, in the electronic control unit, the first electronic control circuit of the switch and the second electronic control circuit of the switch have a common part.

According to an embodiment, the electronic control unit comprises means for measuring the electrical power source of the energizer.

According to an embodiment, the electronic control unit comprises means for conserving the state of the switch controlling the electrical power supply of the energizer, in case of temporary outage of the electrical power source of said electronic control unit.

According to an embodiment, the electronic control unit has an internal resource for topping up power, ensuring that it has sufficient autonomy, and software means for transmitting, in RF mode, an alert message when there is an uncontrolled interruption of the electrical power supply of the energizer.

According to an embodiment, the electronic control unit comprises means for measuring dissuasion pulses circulating on the wire of the electric fence, at the galvanic link.

According to an embodiment, the electronic control unit comprises software means for transmitting, in RF mode, a possible energizer failure message when said measurement reveals that the dissuasion pulses have stopped on the wire of the electric fence without the switch having been controlled.

According to an embodiment, the software means control the opening of the switch controlling the electrical power supply of the energizer when the means for measuring the dissuasion pulses measure, on the wire of the electric fence, an excessively high characteristic of the dissuasion pulses, such as the voltage, the current, the energy, or the frequency of the dissuasion pulses.

According to an embodiment, the electronic control unit comprises electronic and software means for detecting the accidental presence of a hazardous permanent alternating current on the wire of the electric fence, and for opening the switch controlling the electrical power supply of the energizer following such a detection.

According to an embodiment, the electronic control unit has a second galvanic link electrically insulated from the first galvanic link and intended for a second electric fence supplied with other dissuasion pulses by another energizer.

According to an embodiment, the electronic control unit comprises at least one sensor out of the set of motion, temperature, humidity and noise sensors, and software means for transmitting, by the RF chip, an alert message when the measurement by the at least one sensor reveals on its own, or in combination with the measurement of the electrical power source of the energizer, a possibility of manipulation, damage to, movement or theft of the energizer.

According to an embodiment, the electronic control unit comprises software means for modifying, by repeated opening then closing of the switch, the time that elapses between two successive dissuasion pulses circulating on the wire of the electric fence.

According to an embodiment, the electronic control unit comprises software and electronic means for varying the electrical power supply voltage of the energizer in order to modify the size and/or the frequency of the dissuasion pulses circulating on the wire of the electric fence.

According to an embodiment, the electronic control unit comprises a light sensor and software means for, when night comes, opening and closing the switch at a determined rate in order to save on the consumption of the energizer when the wire of the electric fence has less risk of being stressed by the animals.

According to an embodiment, the electronic control unit comprises software and/or electronic means and an output terminal or additional galvanic link for connection to an auxiliary ground terminal independent of the main ground terminal used by the energizer, in order to perform the measurement, by the electronic unit, of the quality of the main ground terminal.

According to an embodiment, the software means ensure the transmission, in RF mode, of a message relating to a measurement when the latter has varied by more than X %, or by more than a predetermined value, relative to the last transmission.

According to an embodiment, the electronic control unit has electronic and/or software means for accumulating and compressing, into a single message, the useful part of at least two successive messages uploading to the RF chip.

According to an embodiment, the electronic control unit comprises electronic and software means for transforming RF signals received by the RF chip into transmitted signals conducted by the wire of the electric fence.

According to an embodiment, the electronic and/or software means for transforming the received signals, conducted or RF, into transmitted signals, RF or conducted, remain operational when the switch controlling the electrical power supply of the energizer is open.

According to an embodiment, the electronic control unit comprises a human-machine interface, such as a sensitive display screen, LEDs, a bar graph, buttons, a keyboard or the like, allowing the user to locally obtain, edit or modify a complex information item, processed by the first electronic circuit or the second electronic circuit, such as a measurement, an alert message transmitted by the electronic unit or passing through it, or a parameter configuration.

BRIEF DESCRIPTION OF THE DRAWINGS

Other features and advantages of the invention will emerge from the following description given with reference to the attached drawings in which.

DETAILED DESCRIPTION

Figure 1:
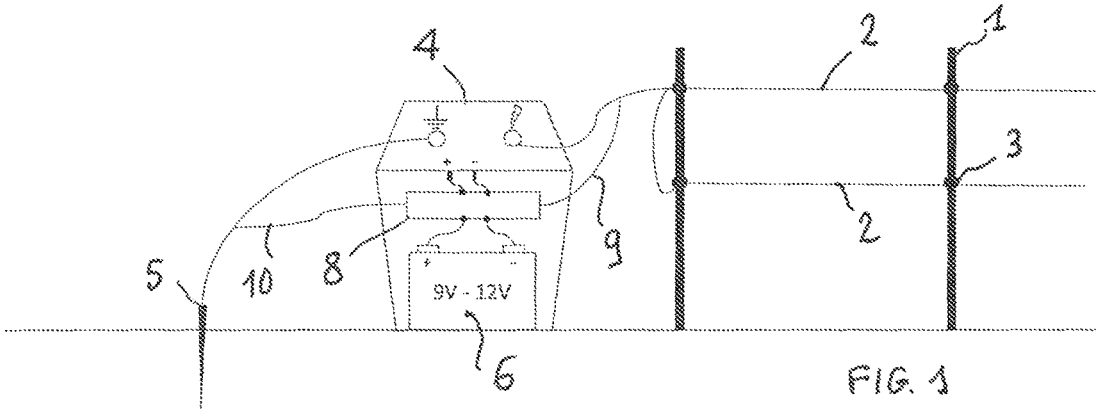
FIG. 1 is a schematic representation of an exemplary embodiment of an electric fence with piggyback unit between the energizer and its direct current battery power supply.
Figure 2:
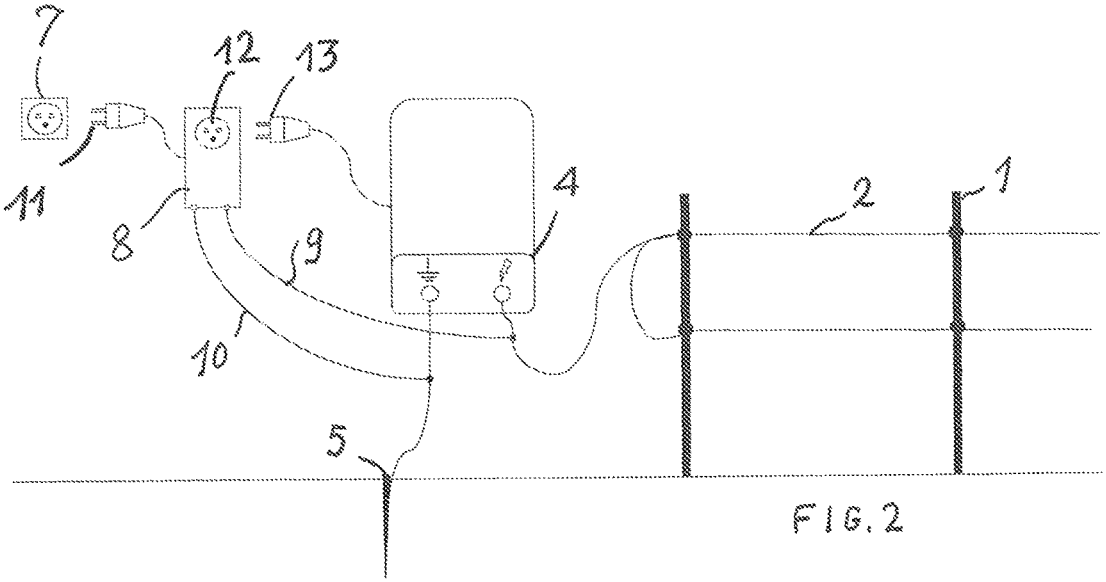
FIG. 2 is a schematic representation of an exemplary embodiment of an electric fence with piggyback unit between the energizer and its alternating current mains power supply.
Figure 3:
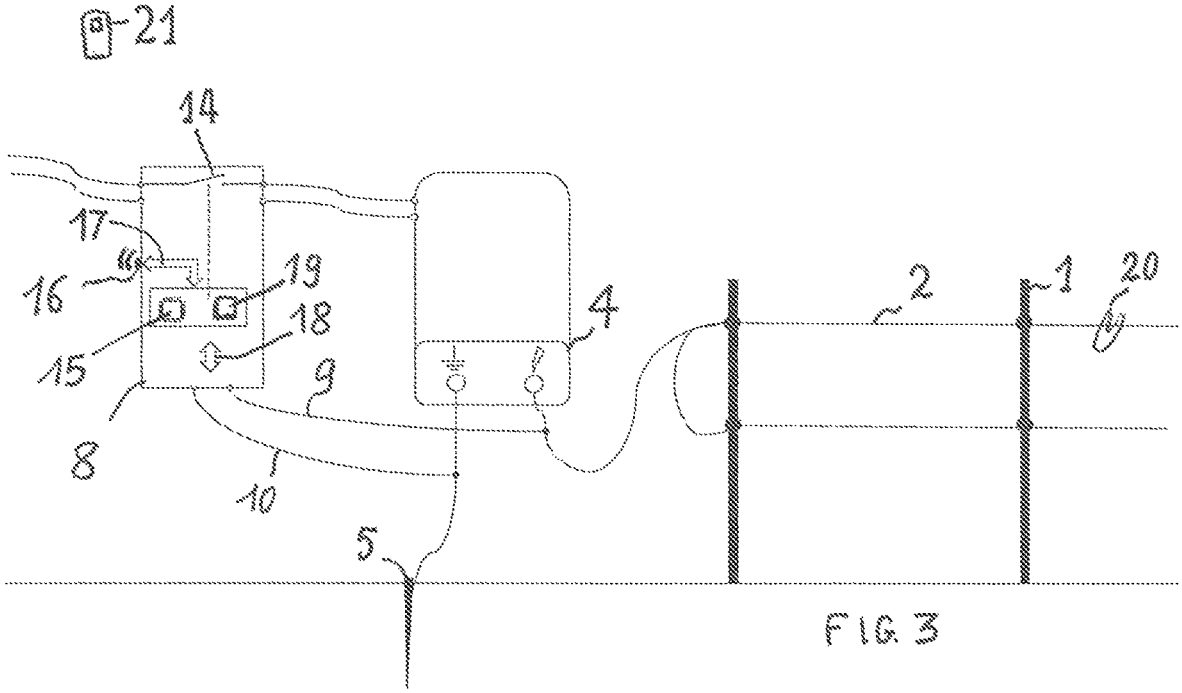
FIG. 3 is a schematic representation of an exemplary embodiment of an electric fence with piggyback unit whose functions are symbolically illustrated.
Figure 4:
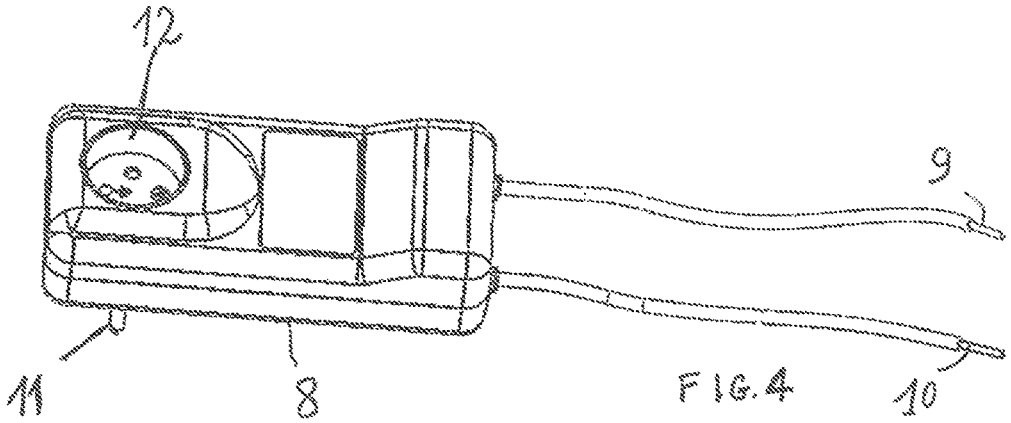
FIG. 4 is a schematic representation of an exemplary embodiment of a piggyback unit for connection to the alternating current of the mains according to the invention.

An electric fence of conventional type comprises posts 1 supporting one or more fence wires 2 by means of insulators 3. An energizer 4 is connected between the fence wire 2 and an earth terminal 5. The electrical power supply of the energizer 4 is provided either in direct current by a battery 6 (FIG. 1), or in alternating current by the mains 7 (FIG. 2).

Between the electrical power source (6, 7) of the energizer and the energizer 4 itself there is a piggyback unit 8.

The piggyback unit 8 comprises a galvanic link with the electric fence by means of a wire 9 linked to the fence wire 2 and a wire 10 linked to the ground terminal 5.

In the case of an alternating current power supply by the mains 7, the piggyback unit 8 is placed directly on the mains 7 outlet by means of its male plug 11 and it receives, in its female socket 12, the male plug 13 of the energizer 4. In the piggyback unit 8, between the male plug 11 and the female socket 12, there is a switch 14 for controlling the electrical power supply of the energizer 4. In the case of a direct current power supply, the principle would remain the same, the switch 14 being arranged from the electrical point of view between terminals for connecting to the cell/battery on one side and to the energizer on the other.

The electronic control unit for an electric fence, or piggyback unit 8 comprises a transmitting and receiving RF chip 16, and a first electronic control circuit 15 of the switch 14, linked to the RF chip 16 by a link symbolized as 17. The piggyback unit 8 comprises a second electronic control circuit 19 of the switch 14, linked, by a link symbolized as 18, to the electric fence via the galvanic link 9, 10. Advantageously, the first electronic control circuit 15 of the switch 14, and the second electronic control circuit 19 of the switch 14, have a common part, in particular for controlling the switch 14 and the communication between the RF chip 16 and the wire 2 of the electric fence. The first electronic circuit 15 comprises, in particular, a programmable transceiver, a microcontroller, a memory and a switch control relay. The second electronic circuit 19 comprises, in particular, a transformer and/or an isolating capacitor, an electronic stage for demodulating the conducted signal, a microcontroller, a memory, and, in an advantageous embodiment, a generator of modulated signals. Together, the first and second electronic circuits 15, 19 combine the electronic means for transforming signals conducted by the wire of the fence into RF signals transmitted by the RF chip, and, in the advantageous embodiment, vice versa.

The system for controlling the electrical power supply of the energizer 4 for an electric fence comprises, in addition to the electronic control unit 8, a pocket remote control 20 operating on contact with the wire 2 of the electric fence, and a pocket radio controller 21, such as a smartphone or an RF remote control.

The operation of the system for controlling the electrical power supply of an energizer for an electric fence according to the method is analyzed as follows, starting from an electric fence that is active, whose fence wire is being passed through by dissuasion pulses transmitted by the energizer. In case of intervention on the electric fence, it is necessary to command the opening of the switch 14 to ensure that the energizer 4 is stopped.

This control of opening of the switch 14 is advantageously handled by the user of the fence, by means of pocket radio controller 21 which addresses RF signals to the RF chip 16 of the piggyback unit 8. The RF signals received by the RF chip 16 are processed by the first electronic circuit 15 which controls the opening of the switch 14. The intervention planned on the electric fence can then take place without risk.

Once the intervention is completed, for example after having cleared away the vegetation that has overgrown this part of the fence and having, in the meantime, advanced by a few kilometers, the operative commands the restoration of the electrical power supply of the energizer 4, by means of the pocket remote control 20, placed in contact with the wire 2 of the electric fence, and which sends to the piggyback unit 8 signals conducted by the wire of the electric fence. These signals are conducted by the wire 2 of the electric fence and by the wire 9 of the galvanic link to the second electronic circuit 19 which controls the closing of the switch 14 and the restoration of operation of the electric fence. The piggyback unit 8 comprises electronic and/or software means for transforming signals conducted by the wire of the electric fence into RF signals transmitted by the RF chip 16. To this end, the first electronic circuit 15 and the second electronic circuit 19 advantageously have a common part forming all or part of said electronic means, for ensuring the transformation of the conducted signals into RF signals and, in a possible advantageous embodiment of the invention, vice versa.

The RF signals are transmitted to the pocket radio controller 21, so that, for example, the user of the fence, if he or she is not the operative working on the fence, is informed of the restoration of the fence. In this way, two people can work in tandem while being away from one another and advancing separately along a complex electric fence without the risk of the person holding the radio controller remaining uninformed of the fact that the person holding the remote control has just restored the power supply of the fence.

The electronic control unit for an electric fence, or piggyback unit 8, ensures a certain number of functions.

It ensures the control of the power supply switch 14 of the energizer 4 in response to signals transmitted by a handheld remote control 20 and conducted by the fence wire 2, the galvanic link wire 9 and the internal link 18 to the second electronic control circuit 19 of the switch 14.

It ensures the same control of the switch 14 in response to RF signals transmitted by a pocket radio controller 21, consisting of an RF remote control or a smartphone, received by the RF chip 16 and transmitted to the first electronic control circuit 15 of the switch 14, by the internal link 17.

In an advantageous variant of the system of the invention, it ensures the conversion of RF signals received by the RF chip 16 and coming from the smartphone of the user of the fence, into signals conducted by the fence wire to specific elements of the electric fence such as transponders or barrier passages, to control them.

Likewise, it ensures the conversion of RF signals received by the RF chip 16 into signals conducted by the fence wire 2 to control elements, distinct from the electric fence, such as drinking troughs.

Conversely, it advantageously ensures the conversion of signals conducted by the fence wire 2 and transmitted by elements specific to the electric fence or distinct from the electric fence, into RF signals transmitted by the RF chip 16 to the smartphone of the user to signal to him or her either the sequence programed operations, like the opening of a drinking trough, or the occurrence of incidents, like a barrier passage opening.

To sum up, in the most advantageous versions of the system of the invention, the piggyback unit 8 ensures, by a remotely-situated user, the control, by a conducted control channel, such as by an RF control channel, of the power supply switch 14 of the energizer 4, and the two-way transmission of information relating to the ecosystem of the electric fence, from or to the smartphone of the user.

In case of deliberate intervention at one point of the electric fence, the user thus has available two means for controlling the energizer: a handheld remote control 20 to be placed in contact with the fence wire, and a smartphone 21, allowing him or her to avoid having to go to the energizer. He or she thus has a two-fold capability. The first, at any point of the fence where the electrical path from/to the energizer may be degraded between the start and the end of an intervention that takes time, for example because of a barrier passage left open in the meantime by a walker upstream. The second at any point of the fence where the smartphone may be located in an area not served by an RF communication network.

In addition, the software means linked to the electronic circuits 15, 19 ensure the conservation in memory of the state of the switch 14, open or closed. In case of intervention on the fence, the switch is opened remotely. If, during the intervention, the electrical power supply undergoes a temporary outage, because of a mains outage or a change of battery, the conservation in memory of the state of the switch ensures, when the electrical power supply is restored, that the switch is kept in or restored to the open position. This capacity to conserve in memory the state of the switch 14 by the software means linked to the electronic circuits 15, 19 guarantees the safety of the user working on the electric fence, by avoiding having the energizer restart pulses on the fence wire.

Other advantages linked to the system comprising the electronic control unit for an electric fence described above are manifold.

The piggyback unit advantageously comprises means for measuring the electrical power source of the energizer 4 and of informing the user in case of anomaly.

The piggyback unit preferably comprises means for measuring the pulses circulating on the electric fence wire and of informing the user in case of drift.

The piggyback unit advantageously has an internal resource for topping up power, ensuring that it has sufficient autonomy, for example a battery or a capacitor, and software means allowing it, for example, to transmit, in RF mode, an alert message when the electrical power supply of the energizer has just been interrupted without this interruption having been controlled. This, for example, to warn the user as early as possible of a possible attempted theft of the battery powering the energizer, or of a prolonged mains failure.

When the measurement of the dissuasion pulses reveals that the pulses have stopped without the switch having received an opening command, the software means of the piggyback unit transmit, in RF mode, a possible failure message. This, for example, to warn the user as early as possible of a possible hardware failure or an attempted theft of the energizer.

According to an embodiment, when the measurement of the pulses reveals an excessively high characteristic such as the voltage, the current, the energy or the frequency, the software means of the electronic control unit open the switch. Some energizer technologies can in fact exhibit significant drifts of operation when the components age, and, to this end, the system of the invention can advantageously specifically limit the risk incurred.

The electronic and software means of the piggyback unit are preferably able to detect the presence of a permanent alternating current on the wire of the electric fence and then trigger the opening of the switch 14. This to deal with the case of an electric fence running alongside a high-voltage line of the mains grid over an excessively long distance, and thereby experiencing a significant induced current.

The piggyback unit can have a second galvanic link, electrically insulated from the first galvanic link (9, 10) and possibly an associated second switch, all being intended for a second electric fence supplied with other dissuasion pulses by another energizer.

The piggyback unit can comprise one or more sensors out of the set of motion, temperature, humidity and noise sensors, and software means for transmitting, by the RF chip, an alert message when the measurement by one or more of these sensors reveals on its own, or in combination with the measurement of the electrical power source of the energizer, a possibility of manipulation, damage to, movement or theft of the energizer.

The piggyback unit advantageously comprises software means for modifying, by repeated opening and closing of the switch, the time that elapses between two successive dissuasion pulses circulating on the wire of the electric fence in order, for example, to save on the electricity consumption of the fence.

According to an embodiment, the piggyback unit comprises software and electronic means for varying the electrical power supply voltage of the energizer in order to modify the size and/or the frequency of the dissuasion pulses circulating on the wire of the electric fence. The characteristics of these pulses can in fact, very often for a given energizer, vary significantly as a function of small variations of the voltage of its electrical power supply about its nominal voltage.

Advantageously, the piggyback unit comprises a light sensor and software means for, when night comes, opening and closing the switch at a determined rate in order to save on the electrical consumption of the energizer (4) when the wire of the electric fence has less risk of being stressed by the animals.

Preferably, the piggyback unit comprise software and/or electronic means and an output terminal or additional galvanic link, for connection to an auxiliary ground terminal independent of the main ground terminal used by the energizer, to perform a measurement of the quality of the main ground terminal.

According to an embodiment, when a measurement has varied by more than a determined value, or in a determined proportion relative to the reference value, the piggyback unit transmits, in RF mode, an alert message.

Preferably, the piggyback unit has electronic and/or software means for accumulating and compressing, into a single message, the useful part of at least two successive messages uploading to the RF chip.

Advantageously, the piggyback unit comprises electronic and software means for transforming RF digital signals received by the RF chip into transmitted digital signals conducted by the wire of the electric fence.

Preferably, the electronic and/or software means for transforming the received signals, conducted or RF, into transmitted signals, RF or conducted, remain operational when the switch controlling the electric power supply of the energizer is open.

Advantageously, the piggyback unit comprises a human-machine interface, such as a sensitive display screen, LEDs, a bar graph, buttons, a keyboard or the like, allowing the user to locally obtain, edit or modify a complex information item, processed by the first electronic circuit or the second electronic circuit, such as a measurement, an alert message transmitted by the piggyback unit or passing through it, or a parameter configuration.

The user who has an electric fence with an old energizer can equip it with a piggyback unit and benefit on his or her fence from the capabilities and performance characteristics associated with this unit, that is to say the possibility:

of conserving his or her old fence and energizer, of controlling the energizer remotely by his or her remote control and signals conducted by the fence wire, of controlling the energizer remotely by his or her smartphone and RF signals, of installing, on his or her fence, transponders, barrier passages and distinct accessory elements, and of using them continually, that is to say even when the energizer is stopped, of switching off the fence using his or her smartphone, and of restarting it using his or her remote control, by then receiving the information on the smartphone concerning this restart controlled by the remote control and not by the smartphone.

The arrangement on an old electric fence of the piggyback unit described above allows the user to benefit from the performance characteristics of a modern electric fence.

The invention claimed is:

1. A method for controlling a system for controlling the electrical power supply of an energizer for an electric fence, the electric power supply having:

an electronic control unit, connected between the energizer and its electrical power supply, comprising a transmitting and receiving RF chip, a switch controlling the electrical power supply of the energizer, a first electronic control circuit of the switch, controlled by RF signals, a galvanic link with the electric fence, and a second electronic control circuit of the switch, controlled by signals conducted by the wire of the fence, a pocket radio controller exchanging RF signals with the RF chip, a pocket remote control transmitting signals conducted by the wire of the electric fence, wherein said method comprises by the following steps:

a) sending, by the radio controller, of RF control signals stopping the electrical power supply of the energizer, received by the first electronic circuit via the RF chip and ensuring the opening of the switch, b) subsequently, sending, by the remote control, of control signals restoring the electrical power supply of the energizer, conducted by the wire of the electric fence, received by the second electronic circuit via the galvanic link, and ensuring the closing of the switch, and c) transmission by the first electronic circuit of RF signals reporting the closing of the switch, via the RF chip, to the radio controller.

2. A system for controlling the electrical power supply of an energizer for an electric fence for implementing the control method as claimed in claim 1, comprising a pocket radio controller such as a smartphone or an RF remote control, and an electronic control unit, connected between the energizer and its electrical power supply, incorporating a transmitting and receiving RF chip, exchanging RF signals with the pocket radio controller, also incorporating a switch controlling the electrical power supply of the energizer, and also incorporating a first electronic control circuit of the switch exchanging RF signals with the RF chip, said system comprising:

it comprises a pocket remote control transmitting signals conducted by the wire of the electric fence, the electronic control unit incorporates a galvanic link with the electric fence, the electronic control unit incorporates a second electronic control circuit of the switch, receiving, from the pocket remote control, via the galvanic link, signals conducted by the wire of the electric fence, and the electronic control unit incorporates electronic and/or software means for transforming said signals conducted by the wire of the electric fence into RF signals transmitted by the RF chip.

3. The system as claimed in claim 2, wherein, in the electronic control unit, the first electronic control circuit of the switch and the second electronic control circuit of the switch have a common part.

4. The system as claimed in claim 2, wherein the electronic control unit comprises means for measuring the electrical power source of the energizer.

5. The system as claimed in claim 2, wherein the electronic control unit comprises means for conserving the state of the switch controlling the electrical power supply of the energizer, in case of temporary outage of the electrical power source of said electronic control unit.

6. The system as claimed in one of claim 2, wherein the electronic control unit has an internal resource for topping up power in case of need, ensuring that it has sufficient autonomy, and software means for allowing it to transmit, in RF mode, an alert message when there is an uncontrolled interruption of the electrical power supply of the energizer.

7. The system as claimed in claim 2, wherein the electronic control unit comprises means for measuring dissuasion pulses circulating on the wire of the electric fence, at the galvanic link.

8. The system as claimed in claim 7, wherein the electronic control unit comprises software means for transmitting, in RF mode, a possible energizer failure message when said measurement reveals that the dissuasion pulses have stopped on the wire of the electric fence without the switch having been controlled.

9. The system as claimed in claim 7, wherein the software means control the opening of the switch controlling the electrical power supply of the energizer when the means for measuring the dissuasion pulses measure, on the wire of the electric fence, an excessively high characteristic of the dissuasion pulses, such as the voltage, the current, the energy, or the frequency of the dissuasion pulses.

10. The system as claimed in claim 2, wherein the electronic control unit comprises electronic and software means for detecting the accidental presence of a hazardous permanent alternating current on the wire of the electric fence and opens the switch controlling the electrical power supply of the energizer following such a detection.

11. The system as claimed in claim 2, wherein the electronic control unit has a second galvanic link electrically insulated from the first galvanic link and intended for a second electric fence supplied with other dissuasion pulses by another energizer.

12. The system as claimed in claim 2, wherein the electronic control unit comprises at least one sensor out of the set of motion, temperature, humidity and noise sensors, and software means for transmitting, by the RF chip, an alert message when the measurement by the at least one sensor reveals on its own, or in combination with the measurement of the electrical power source of the energizer, a possibility of manipulation, damage to, movement or theft of the energizer.

13. The system as claimed in claim 2, wherein the electronic control unit comprises software means for modifying, by repeated opening then closing of the switch, the time that elapses between two successive dissuasion pulses circulating on the wire of the electric fence.

14. The system as claimed in claim 2, wherein the electronic control unit comprises software and electronic means for varying the electrical power supply voltage of the energizer in order to modify the size and/or the frequency of the dissuasion pulses circulating on the wire of the electric fence.

15. The system as claimed in claim 2, wherein the electronic control unit comprises a light sensor and software means for, when night comes, opening and closing the switch at a determined rate in order to save on the consumption of the energizer when the wire of the electric fence has less risk of being stressed by the animals.

16. The system as claimed in claim 2, wherein the electronic control unit comprises software and/or electronic means and an output terminal or additional galvanic link for connection to an auxiliary ground terminal independent of the main ground terminal used by the energizer, in order to perform the measurement, by the electronic unit, of the quality of the main ground terminal.

17. The system as claimed in claim 2, wherein said software means ensure the transmission, in RF mode, of a message relating to a measurement when the latter has varied by more than X %, or by more than a predetermined value, relative to the last transmission.

18. The system as claimed in claim 2, wherein the electronic control unit has electronic and/or software means for accumulating and compressing, into a single message, the useful part of at least two successive messages uploading to the RF chip.

19. The system as claimed in claim 2, wherein the electronic control unit comprises electronic and software means for transforming RF signals received by the RF chip into transmitted signals conducted by the wire of the electric fence.

20. The system as claimed in claim 17, wherein the electronic and/or software means for transforming the received signals, conducted or RF, into transmitted signals, RF or conducted, remain operational when the switch controlling the electrical power supply of the energizer is open.

21. The system as claimed in claim 2, wherein the electronic control unit comprises a human-machine interface, such as a sensitive display screen, LEDs, a bar graph, buttons, a keyboard or the like, allowing the user to locally obtain, edit or modify a complex information item, processed by the first electronic circuit or the second electronic circuit, such as a measurement, an alert message transmitted by the electronic unit or passing through it, or a parameter configuration.

* * * * *